United States Patent [19]

Shibano

[11] Patent Number: 4,499,032

[45] Date of Patent: Feb. 12, 1985

[54] SYSTEM FOR PREVENTING THE PERCOLATION OF FUEL IN A CARBURETOR

[75] Inventor: Kenji Shibano, Musashimurayama, Japan

[73] Assignee: Fuji Jukogyo Kabushiki Kaisha, Tokyo, Japan

[21] Appl. No.: 485,846

[22] Filed: Apr. 18, 1983

[30] Foreign Application Priority Data

Apr. 20, 1982 [JP] Japan ..... 57-65998

[51] Int. Cl.[3] ..... F02M 5/08

[52] U.S. Cl. ..... 261/72 R; 261/DIG. 67; 261/DIG. 74; 261/DIG. 81

[58] Field of Search ..... 261/DIG. 81, DIG. 67, 261/DIG. 74, 72 R

[56] References Cited

U.S. PATENT DOCUMENTS

| | | | |
|---|---|---|---|
| 1,586,683 | 6/1926 | Mock | 261/DIG. 67 |
| 2,754,005 | 7/1956 | Tursky | 210/323.2 |
| 2,981,416 | 5/1961 | Lawlor | 210/333.1 |
| 2,985,306 | 5/1961 | Statzell | 210/333.1 |
| 3,280,980 | 10/1966 | King | 210/108 |
| 3,637,079 | 1/1972 | Strub | 210/333.01 |
| 3,742,924 | 7/1973 | Bachle | 261/DIG. 67 |
| 3,744,633 | 7/1973 | Schmidt, Jr. et al. | 210/333.01 |
| 3,959,417 | 5/1976 | Tateno et al. | 261/DIG. 67 |
| 4,083,342 | 4/1978 | Bertling | 261/DIG. 74 |
| 4,134,378 | 1/1979 | Kingsley | 261/DIG. 67 |
| 4,256,583 | 3/1981 | Lennartz | 210/333.1 |
| 4,282,105 | 8/1981 | Crowe | 210/412 |
| 4,331,617 | 5/1982 | Tamaki et al. | 261/DIG. 67 |
| 4,343,281 | 8/1982 | Vozumi et al. | 261/DIG. 67 |
| 4,405,466 | 9/1983 | Giannelli et al. | 210/333.01 |

FOREIGN PATENT DOCUMENTS

| | | | |
|---|---|---|---|
| 2757090 | 6/1978 | Fed. Rep. of Germany | 210/333.1 |
| 54-35525 | 3/1979 | Japan | 261/DIG. 67 |
| 54-45427 | 4/1979 | Japan | 261/DIG. 67 |
| 54-120327 | 9/1979 | Japan | 261/DIG. 67 |
| 1020440 | 2/1966 | United Kingdom | 261/DIG. 67 |
| 179121 | 3/1966 | U.S.S.R. | 261/DIG. 67 |

*Primary Examiner*—Tim Miles

*Attorney, Agent, or Firm*—Martin A. Farber

[57] ABSTRACT

A system preventing the percolation of fuel in a carburetor comprising a first passage communicating a space of a float chamber of the carburetor with the atmosphere, a diaphragm valve with a vacuum chamber for closing the passage, and an inner vent pipe for communicating the space of the float chamber with an intake passage of the carburetor. A thermo sensor is provided for sensing the temperature of the carburetor and for producing a signal when the temperature reaches a high temperature which would cause the percolation of the fuel. The diaphragm valve is operated in dependency on the signal of the thermo sensor to open the passage to communicate the space of the float chamber with the atmosphere.

5 Claims, 2 Drawing Figures

SYSTEM FOR PREVENTING THE PERCOLATION OF FUEL IN A CARBURETOR

BACKGROUND OF THE INVENTION

The present invention relates to a system for preventing the percolation of fuel in an intake passage of a carburetor.

Conventionally, there has been proposed various means for preventing the percolation of fuel in the carburetor, such as: insulating of the carburetor by a thermal insulator; ventilation of an engine space of a vehicle for radiating the heat in order to suppress an increase in the temperature of the carburetor; cooling of the carburetor by a fan; and circulation of gasoline from the float chamber of the carburetor to the fuel tank in order to cool the gasoline stored in the float chamber.

However, in recent years, in view of the stylish design of the car, the engine space is designed to have a small capacity. Accordingly, it is difficult to occupy a large space in the engine space for providing ventilating means or a fan, and insulating the carburetor is not sufficient to prevent the percolation of fuel since the heat capacity of the carburetor is large. Further, the circulation system of gasoline between the float chamber and the fuel tank appears to be unreliable in effect.

SUMMARY OF THE INVENTION

An object of the present invention is to provide a system which can effectively cool the carburetor by keeping gasoline vapor in the space of the carburetor in unsaturated state to promote cooling by evaporation of gasoline.

As prior art, Japanese utility model laid-open specification No. 51-32332 discloses a system wherein the space of the float chamber is communicated with the atmosphere and the pressure in the float chamber is raised so as to increase the flow rate. This disclosure is different in object and in operation from the present invention.

According to the present invention, there is provided a system preventing the percolation of fuel in a carburetor of an engine, comprising: a first passage communicating an upper space of a float chamber of the carburetor with the atmosphere; a diaphragm valve for closing the passage; an inner vent pipe for communicating the space of the float chamber with an intake passage of the carburetor; a thermo sensor for sensing the temperature of the carburetor and for producing a signal when the temperature reaches a high temperature which would cause the percolation of the fuel and for opening the valve in dependency on the signal of the thermo sensor.

The present invention will be more apparent from the following description made with reference to the accompanying drawings.

DETAILED DESCRIPTION OF THE PREFERRED EMBODIMENTS

Figures 1, 2:
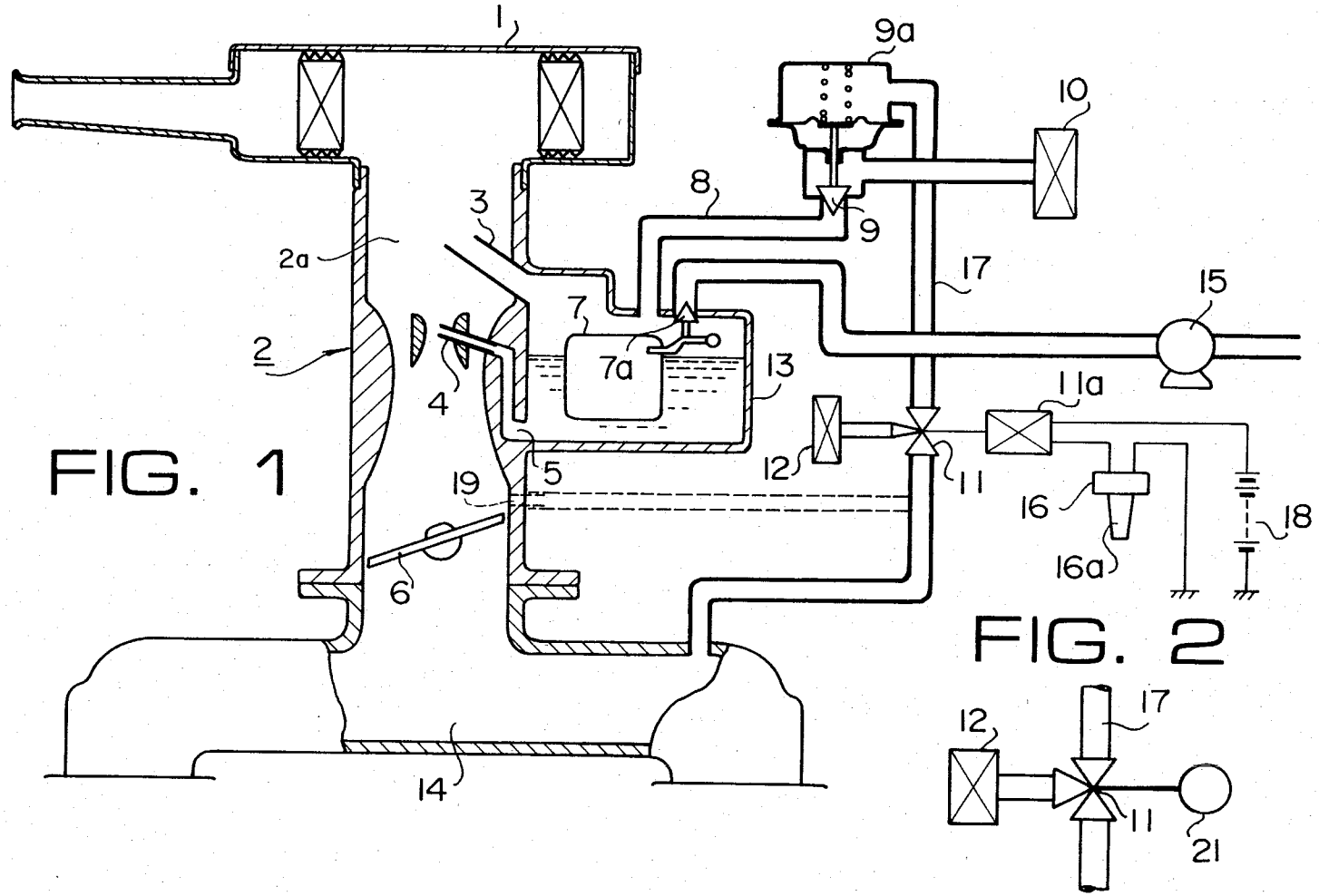
FIG. 1 is a schematic view of an embodiment of the present invention.
FIG. 2 is a schematic view showing a part of another embodiment of the present invention.

Referring to FIG. 1, a carburetor 2 comprises a main nozzle 4, an inner vent pipe 3 extending to an intake passage 2*a* of the carburetor and communicating with an upper space of a float chamber 13, and a main jet 5.

Air flowing into an air cleaner 1 is mixed in the carburetor 2 with gasoline vapor from the inner vent pipe 3 and with gasoline from the main nozzle 4. The mixture passes further to an intake pipe 14 of an engine (not shown) through a throttle valve 6 the intake pipe 14 being downstream of the intake passage 2*a* communicating therewith. The gasoline is supplied to the carburetor from the main nozzle 4 through the main jet 5. A float 7 in the float chamber 13 cooperates with a valve body 7*a* to introduce the gasoline from the fuel tank (not shown) to the float chamber 13 through a fuel pump 15 to maintain a predetermined level.

In the present embodiment, an induction passage 8 is provided to communicate the upper space of the float chamber 13 with the atmosphere through a diaphragm valve 9 and a filter 10.

The diaphragm valve 9 is provided with a vacuum chamber 9*a* which is in communication with the intake pipe 14 through a passage 17. A three-way valve 11 is provided in the passage 17. The three-way valve 11 is operated by a solenoid 11*a* so as to communicate the vacuum chamber 9*a* either with the intake pipe 14 through the passage 17 or with the atmosphere through a filter 12. The solenoid 11*a* is supplied with voltage from a battery 18 through a thermo switch 16 which is closed by a signal fed from a thermo sensor 16*a*. The thermo sensor 16*a* is attached to a suitable portion of the wall of the carburetor, intake pipe or radiator of the engine and is adapted to generate the signal when the temperature of the wall rises to such a high temperature that the percolation of the gasoline occurs. Thus, when the switch 16 closes by the signal from the sensor 16*a*, the three-way valve 11 is shifted by the solenoid 11*a* in such a direction as to communicate the vacuum chamber 9*a* with the intake pipe 14.

Thus, when the temperature of the carburetor rises to the high temperature, switch 16 is closed to shift the three-way valve 11, so that the vacuum chamber 9*a* is communicated with the intake pipe 14. Accordingly, the pressure in the vacuum chamber 9*a* becomes negative to deflect the diaphragm 9 to open the valve 9. Thus, air is drawn into the upper space of the float chamber 13 through the filter 10 and the induction passage 8 and further to the inner vent pipe 3. The current of the air through the float chamber reduces the pressure in the chamber below the saturated vapor pressure. Thus, evaporation of the gasoline is promoted, so that the temperature of the surface of the gasoline in the float chamber is lowered by the evaporation. The temperature difference between the surface and the lower part of the gasoline causes the convection to decrease the temperature of the gasoline as a whole, so that the percolation of the gasoline can be prevented. In this construction, it is more effective to dispose the port of the induction passage 8 to open to the float chamber 13 apart from the inner vent pipe 3.

When the engine operation is stopped, the vacuum in the intake pipe 14 decreases. Consequently, the diaphragm valve 9 closes, so that the generated vapor of the gasoline does not flow out from the float chamber 13 through the filter 10.

When the throttle valve 6 is fully opened or almost fully opened, the pressure in the intake pipe 14 reduces and the diaphragm 9 closes. However, percolation will not occur, because a large amount of gasoline is supplied to the float chamber.

Although the diaphragm valve 9 is actuated only by the negative pressure in the intake pipe 14 in the above mentioned embodiment, it is noted that an advance port 19 shown by broken lines in the figure can also be used to operate the diaphragm valve 9 at idling operation of the engine.

FIG. 2 shows a part of a second embodiment of the present invention. In the second embodiment, a thermostat 21 is attached to a suitable portion of the carburetor and is provided to mechanically actuate the three-way valve 11. Thus, when the thermostat 21 is operated at a high temperature of the carburetor, the three-way valve is shifted to communicate the vacuum chamber 9*a* with the intake pipe 14. Other portions of the system are the same as the first embodiment in construction and operation.

The system of the present system is provided with an air supply passage in communication with the space of the float chamber and a valve mechanism in the air supply passage, wherein the valve mechanism opens when the temperature of the carburetor is raised in order to reduce the vapor pressure in the chamber and to keep the pressure below the saturated vapor pressure. Thus, the temperature of the surface of the fuel in the float chamber is lowered by the evaporation, so that the percolation of the fuel is prevented. In this system, the temperature of the fuel itself can also be kept low as stated, and the effect of preventing of percolation can be ensured.

While the presently preferred embodiments of the present invention has been shown and described, it is to be understood that this disclosure is for the purpose of illustration and that various changes and modifications may be made without departing from the spirit and scope of the invention as set forth in the appended claims.

What is claimed is:

1. A system preventing the percolation of fuel in a carburetor for an engine having a float chamber, comprising:

a first passage communicating a space of said float chamber with the atmosphere;

means comprising a diaphragm valve with a vacuum chamber for closing said passage;

an inner vent pipe for communicating the space of the float chamber with an intake passage of said carburetor; and means for sensing a high temperature which would cause the percolation of the fuel and for opening said diaphragm valve.

2. The system according to claim 1, wherein said means comprises a thermostat means for actuating said diaphragm valve.

3. The system according to claim 1, wherein:

said vacuum chamber is operatively connected to and operative by vacuum in an intake pipe of said engine for the opening of said diaphragm valve in response to said sensing means, said intake pipe being downstream of said intake passage.

4. The system according to claim 1 further comprising a second passage communicating said vacuum chamber with the intake pipe of said engine, and said means comprises a thermo sensor and a solenoid valve means operated by signal of the thermo sensor for closing said second passage.

5. The system according to claim 4 further comprising an advance port communicating a portion near a throttle valve in said intake passage of the carburetor with said second passage.

* * * * *